US006102154A

United States Patent [19]

Liu et al.

[11] Patent Number: 6,102,154

[45] Date of Patent: Aug. 15, 2000

[54] MUFFLER

[75] Inventors: Benzhu Liu; Shigeki Wakamatsu, both of Aichi-ken, Japan

[73] Assignee: Sango Co., Ltd., Nagoya, Japan

[21] Appl. No.: 09/150,681

[22] Filed: Sep. 10, 1998

[30] Foreign Application Priority Data

Sep. 12, 1997 [JP] Japan ..... 9-247959

[51] Int. Cl.[7] ..... F01N 1/08

[52] U.S. Cl. ..... 181/265; 181/272; 181/237

[58] Field of Search ..... 181/237, 254, 181/239, 265, 266, 269, 272, 273; 60/312, 324

[56] References Cited

U.S. PATENT DOCUMENTS 4,840,030 6/1989 Ikeda et al. .

4,901,528 2/1990 Saigo et al. .

FOREIGN PATENT DOCUMENTS 2-18265 5/1990 Japan .

*Primary Examiner*—Khanh Dang

*Attorney, Agent, or Firm*—Pillsbury Madison & Sutro, LLP

[57] ABSTRACT

In a muffler, a first exhaust outlet pipe has an opening-closing device, and a second exhaust outlet pipe is connected or joined to the first exhaust outlet pipe at a downstream portion of the opening-closing device. An overall length of the second exhaust outlet pipe is greater than the distance between the above joint portion, at which the second exhaust outlet pipe is connected to the first exhaust outlet pipe, and an exhaust inlet end of the first exhaust outlet pipe, and the overall length of the second exhaust outlet pipe is shorter than or generally equal to an overall length of the first exhaust outlet pipe. With this construction, in a low engine revolution speed range, the production of abnormal sounds in the second exhaust outlet pipe is prevented.

18 Claims, 3 Drawing Sheets

MUFFLER

BACKGROUND OF THE INVENTION

1. Field of the Invention

This invention relates to a muffler (silencer) used in an internal combustion engine for an automobile and the like.

2. Related Art

There is known a muffler in which when an internal combustion engine is operating at high (engine) revolution speed at a high flow rate of exhaust gas, the reduction of a back pressure is regarded as important so as to enhance an output power, and when the engine is at low engine revolution speed at a low flow rate of the exhaust gas, a sound-suppressing effect is regarded as more important than the reduction of the back pressure is. Such a muffler as shown in FIG. 4 is disclosed in JP-Y2-02-18265.

The muffler, shown in FIG. 4, comprises a shell 100 whose interior is partitioned into a first chamber 101, a second chamber 102 and a third chamber 103, an exhaust inlet pipe 104 having perforations 105 through which the interior of this pipe 104 communicates with the first chamber 101, and having one end open to the second chamber 102, a communication pipe 107 which has perforations 106 through which the interior of this pipe 107 communicates with the second chamber 102, and has opposite ends open respectively to the first chamber 101 and the third chamber 103, a first exhaust outlet pipe 109 which has perforations 108 through which the interior of this pipe 109 communicates with the third chamber 103, and has an inner end open to the first chamber 101, and also has an outer end open to the exterior of the shell 100, a outlet pipe 110 connected to the outer end of the first exhaust outlet pipe 109, and a throttle valve 111 provided between the first exhaust outlet pipe 109 and the tail pipe 110.

The muffler further comprises a second exhaust upstream pipe 112 which extends through the first chamber 101 and the second chamber 102, and has an exhaust inlet end open to the third chamber 103, and a second exhaust downstream pipe 113 of a generally U-shape connected to a downstream end of the upstream pipe 112 to form, together with this pipe 112, a second exhaust outlet pipe 114. The second exhaust downstream pipe 113 is turned or bent into a U-shape, and extends along an outer surface of a side wall of the shell 100, and a downstream end of this pipe 113 is connected or joined to that portion of the tail pipe 110 disposed downstream of the throttle valve 111.

The throttle valve 111 comprises an electromagnetic valve (solenoid valve), and the engine revolution speed is detected, and when the engine revolution speed is high, the throttle valve 111 is opened under the control of a control circuit 115, and when the engine revolution speed is low, the throttle valve 111 is closed.

When the engine revolution speed is high, the throttle valve 11 is opened, thereby discharging the exhaust gas, flowed into the muffler through the exhaust inlet pipe 104, through the first exhaust outlet pipe 109 so as to reduce a back pressure. When the engine revolution speed is low, the throttle valve 11 is closed, thereby discharging the exhaust gas, flowed into the muffler through the exhaust inlet pipe 104, through the second exhaust outlet pipe 114 (which is smaller in diameter, and is longer than the first exhaust outlet pipe 109) so as to enhance a sound-suppressing effect.

In the above conventional muffler, however, the second exhaust upstream pipe 112 extends through the two chambers, and the second exhaust downstream pipe 113 extends from a front wall of the muffler in a U-turn manner, and further extends along the side wall of the shell toward a rear end thereof. Therefore, the overall length of the second exhaust outlet pipe 114, constituted by the two pipes 112 and 113, is about twice larger than the overall length of the muffler. The second exhaust outlet pipe 114, having such a large length, has a relatively low columnar resonance frequency.

With respect to the pulsation of the engine, the lower the engine revolution speed is (that is, the lower the frequency is), the stronger the pulsating effect is.

Therefore, in a low engine revolution speed range, the frequency of such intense engine pulsation and the columnar resonance frequency of the second exhaust outlet pipe coincide with each other, and this results in a problem that an intense columnar resonance occurs as indicated by a peak C' of a broken-line curve C (FIG. 5) representing a sound pressure level of the conventional muffler, so that abnormal sounds are produced.

Furthermore, the second exhaust outlet pipe 114 of the above construction is arranged to be projected at the rear side and one side of the muffler, and therefore there is encountered a problem that the muffler can not be formed into a compact design.

SUMMARY OF THE INVENTION

It is therefore an object of this invention to provide a muffler which overcomes the above problems.

According to the present invention as defined in claim 1, there is provided a muffler in which a first exhaust outlet pipe has opening-closing means, and a second exhaust outlet pipe is connected to the first exhaust outlet pipe at a downstream portion of the opening-closing means, wherein an overall length of the second exhaust outlet pipe is greater than a length of a portion of the first exhaust outlet pipe extending between a joint portion, at which the second exhaust outlet pipe is connected to the first exhaust outlet pipe, and an exhaust inlet end of the first exhaust outlet pipe, and the overall length of the second exhaust outlet pipe is shorter than or generally equal to an overall length of the first exhaust outlet pipe.

In this construction, the overall length of the second exhaust outlet pipe is shorter as compared with the conventional construction, and therefore the columnar resonance frequency of the second exhaust outlet pipe shifts to a high-frequency side. Therefore, a columnar resonance due to the pulsation of the engine is prevented from occurring.

Even if a columnar resonance due to the engine pulsation occurs, any serious abnormal sound will not be produced since the engine pulsation decreases as the engine revolution speed increases.

The overall length of the second exhaust outlet pipe is generally equal to the overall length of the first exhaust outlet pipe, and with this construction, the columnar resonance frequencies, possessed respectively by the first and second exhaust outlet pipes, can be set to their respective maximum values while achieving the satisfactory sound-suppressing effect in a low engine revolution speed range, and this is effective.

In the second aspect of the invention, the muffler is divided into a plurality of chambers, and one of the chambers, to which the exhaust inlet of the first exhaust outlet pipe is open, is communicated to other of the chambers provided on an upstream side of the former chamber by a communication pipe. Further, the second exhaust outlet pipe is smaller in diameter than the first exhaust outlet pipe and the communication pipe.

In this construction, in the low engine revolution speed range, the exhaust gas flows through the second exhaust outlet pipe of a smaller diameter, so that a satisfactory sound-suppressing effect can be achieved.

In an engine revolution speed range higher than the low speed revolution range, the exhaust gas flows through the first exhaust outlet pipe of a larger diameter. Therefore, in the engine revolution speed range higher than the low revolution speed range, the production of a gas flow noise can be suppressed, and besides the back pressure will not increase.

In the third and fourth aspects of the invention, part of the second exhaust outlet pipe is projected only outwardly of a front wall of the muffler, or the whole of the second exhaust outlet pipe is received within the muffler.

In this construction, since the second exhaust outlet pipe is shorter as compared with the conventional construction, the second exhaust outlet pipe can be arranged in the above manner, and the overall size of the muffler can be made smaller than that of the conventional construction.

In the invention as defined in claims 5 to 8, the opening-closing means having a valve member is provided at the exhaust inlet end of the first exhaust outlet pipe, and the valve member is opened toward an inner side of the first exhaust outlet pipe by a pressure of the exhaust gas within a chamber to which the first exhaust outlet pipe is open.

In this construction, when the pressure of the exhaust gas within the chamber, to which the first exhaust outlet pipe is open, increases in the engine revolution speed range higher than the low revolution speed range, the valve member of the opening-closing means is opened toward the inner side of the first exhaust outlet pipe by this pressure. Therefore, valve-operating means and control means as used in the conventional construction do not need to be provided, and the muffler can be formed into a compact design, and can be produced at lower costs. And besides, since the valve member is opened toward the inner side of the pipe, the exhaust inlet end of the first exhaust outlet pipe can be located close to the front wall of the muffler, and therefore the degree of freedom of the muffler design is enhanced.

In the invention as defined in claims 9 to 12, the opening-closing means comprises the valve member of the butterfly type, and a coil spring urging the valve member in its closing direction.

In this construction, the valve member is opened by the pressure of the exhaust gas, and is closed by the urging force of the coil spring.

DESCRIPTION OF THE PREFERRED EMBODIMENTS

A preferred embodiment according to the present invention will now be described with reference to FIGS. 1 and 2.

Figure 1:
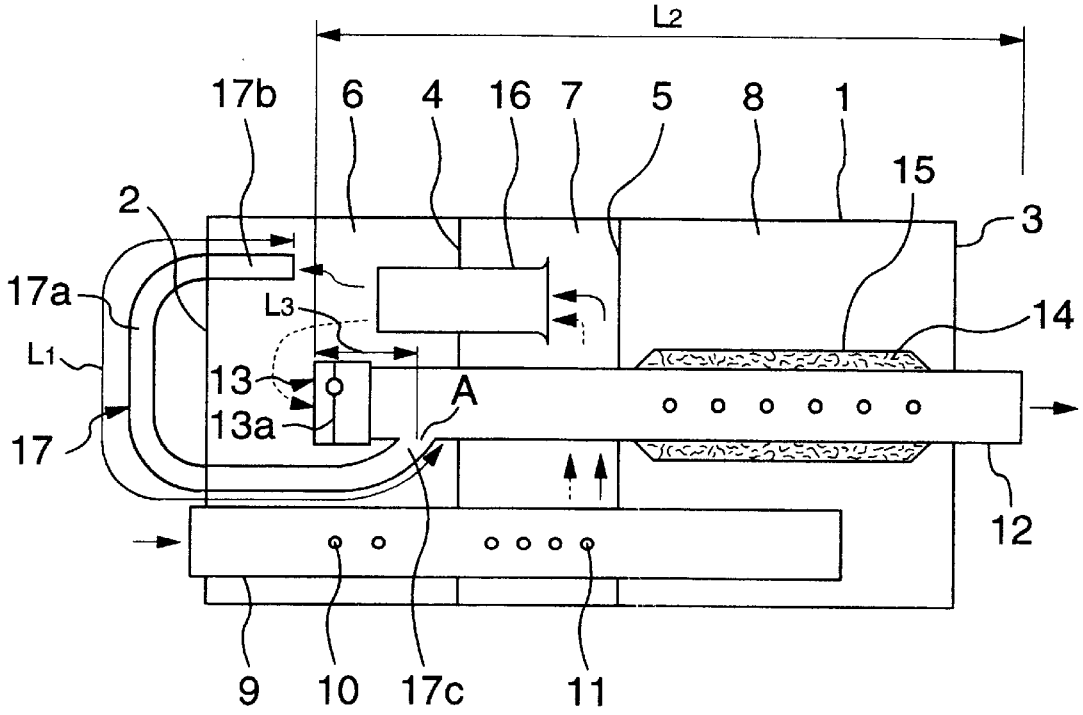
FIG. 1 is a schematic sectional side elevation of a first embodiment of a muffler according to the present invention.

FIG. 1 shows a first embodiment of a muffler according to the invention.

In FIG. 1, front and rear ends of an outer tube 1 of the muffler are closed by front and rear walls 2 and 3, respectively, and the interior of the outer tube 1 is divided or partitioned by partition walls 4 and 5 into a first chamber (expansion chamber) 6, a second chamber (expansion chamber) 7 and a third chamber (resonance chamber) 8.

An exhaust inlet pipe 9 extends through the front wall 2, the first chamber 6 and the second chamber 7, and communicates at its one end (downstream end) with the third chamber 8, and the other end (upstream end) of this pipe 9 communicates with an exhaust pipe of an engine. The exhaust inlet pipe 9 has first perforations (small holes) 10 and second perforations 11 formed through a peripheral wall thereof, and the interior of this pipe 9 communicates with the first chamber 6 through the first perforations 10, and also communicates with the second chamber 7 through the second perforations 11.

A first exhaust outlet pipe 12 has such a diameter as not to increase a back pressure in a high engine revolution speed range, and this pipe 12 extends through the second chamber 7 and the third chamber 8. An upstream end of the first exhaust outlet pipe 12 is open to the first chamber 6 while its downstream end is open to the exterior of the muffler. Opening-closing means (shut-off means) 13 is provided at the upstream end of the first exhaust outlet pipe 12 open to the first chamber 6, and the communication of the first exhaust outlet pipe 12 with the first chamber 6 is made and interrupted by opening and closing a valve member 13*a* of this opening-closing means 13.

Figure 2:
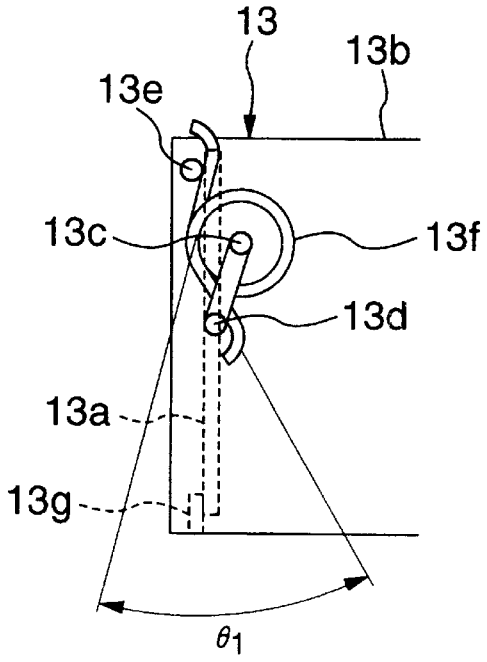
FIG. 2 is a schematic side-elevational view of one example of opening-closing means shown in FIG. 1.

As shown in FIG. 2, the opening-closing means 13 comprises a casing 13*b*, forming a flow passage equal in diameter or bore to the first exhaust outlet pipe 12, the butterfly-type valve member 13*a* which is mounted within the casing 13*b*, and has a rotation shaft 13*c* disposed in eccentric relation to an axis of the casing 13*b*, a coil spring (urging means) 13*f* acting between a spring-retaining portion 13*d* of the rotation shaft 13*c* and a spring retainer 13*e* fixedly secured to the casing 13*b*, and a valve stopper 13*g* fixedly secured to an inner surface of the casing 13*b*. When the pressure of exhaust gas within the first chamber 6 reaches a predetermined level, so that the pressure, acting on the valve member 13*a*, becomes greater than a predetermined urging force of the coil spring 13*f*, the valve member 13*a* is opened against the bias of the coil spring 13*f*. When the pressure of the exhaust gas within the first chamber 6 becomes smaller than the predetermined level, the valve member 13*a* is closed by the urging force of the coil spring 13*f*, and this valve-closed condition is maintained by the valve stopper 13*g*.

The urging force of the coil spring 13*f* is so determined that the valve member 13*a* can be opened by the pressure of the exhaust gas within the first chamber 6 when the engine revolution speed becomes higher than a low revolution speed range (1,500 rpm).

Perforations are formed through that portion of a peripheral wall of the first exhaust outlet pipe 12 disposed within the third chamber 8. Glass wool is wound on the outer periphery of that portion of the first exhaust outlet pipe 12, disposed within the third chamber 8, to form a resonance chamber 15.

A communication pipe 16 is fixedly mounted on the partition wall 4, and communicates the first and second chambers 6 and 7 with each other.

A second exhaust outlet pipe 17 is fixedly mounted on the front wall 2, and is bent into a U-shape to provide a bent portion 17*a* which is disposed adjacent to an outer surface of the front wall 2. One end 17*b* of the second exhaust outlet pipe 17 is open to the first chamber 6, and the other end 17*c* is connected or joined to the first exhaust outlet pipe 12 at a downstream portion of the opening-closing means 13.

An overall length $L_1$ of the second exhaust outlet pipe 17 is shorter than or generally equal to an overall length $L_2$ of the first exhaust outlet pipe 12, and is so determined as to efficiently suppress the sound in the low engine revolution speed range. In the illustrated embodiment, the length $L_1$ is shorter than the length $L_2$.

Further, the overall length $L_1$ of the second exhaust outlet pipe 17 is greater than a length $L_3$ of that portion of the first exhaust outlet pipe 12 extending between a joint portion A (where the second exhaust outlet pipe 17 is connected to the first exhaust outlet pipe 12) and the exhaust inlet end of the first exhaust outlet pipe 12.

Naturally, the length $L_3$ is shorter than the length $L_2$.

The second exhaust outlet pipe 17 is smaller in diameter than the first exhaust outlet pipe 12, and the communication pipe 16 is generally equal in diameter to the first exhaust outlet pipe 12.

The operation of this first embodiment will now be described.

The outer end of the exhaust inlet pipe 9 communicates with the exhaust pipe of the engine, and in this condition, when the engine revolution speed is in the low revolution speed range (not more than 1,500 rpm), the valve member 13*a* of the opening-closing means 13 is held in its closed position. Therefore, in the low engine revolution speed range, the exhaust gas is discharged sequentially through the exhaust inlet pipe 9, the second perforations 11, the second chamber 7, the communication pipe 16, the first chamber 6, the second exhaust outlet pipe 17, the joint portion A and the first exhaust outlet pipe 12.

When the engine revolution speed is higher than the low revolution speed range, the pressure of the exhaust gas within the first chamber 6 increases, so that the valve member 13*a* of the opening-closing means 13 is opened. Therefore, the exhaust gas, produced in the engine revolution speed range higher than the low revolution speed range, flows mainly through the opening-closing means 13 and the first exhaust outlet pipe 12 (which have the larger diameter) rather than through the above exhaust passage (path) used in the low engine revolution speed range.

Figure 4:
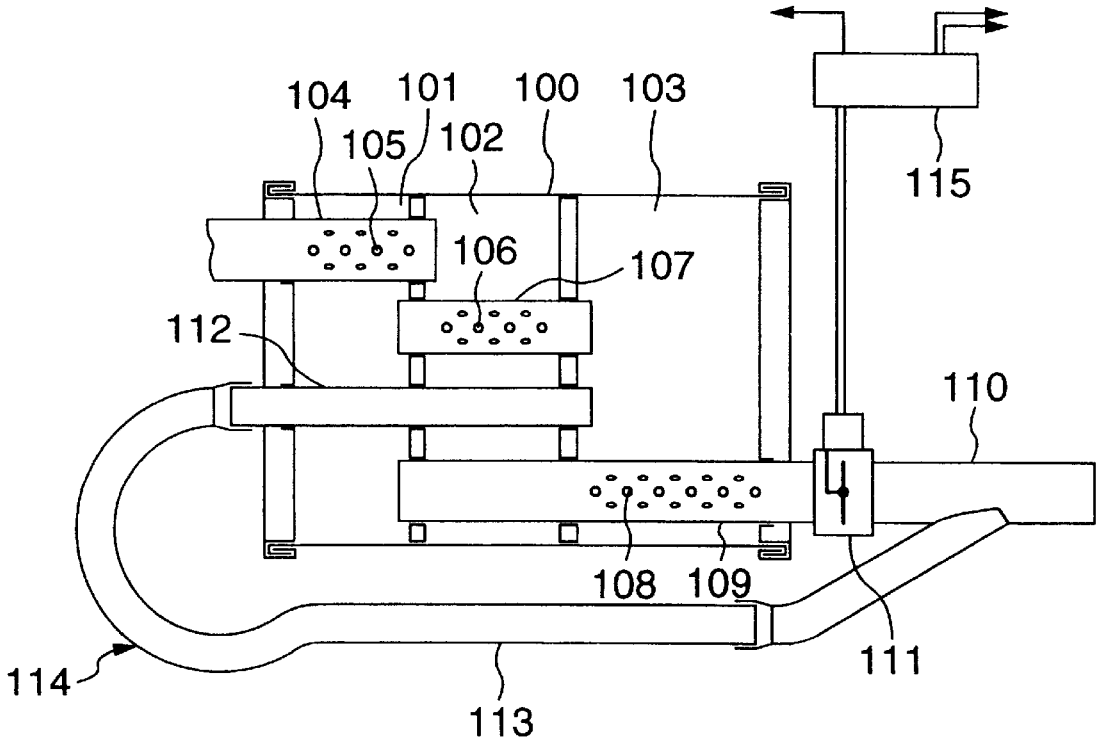
FIG.4 PRIOR ART
FIG. 4 is a schematic sectional elevation of a conventional muffler.
Figure 5:
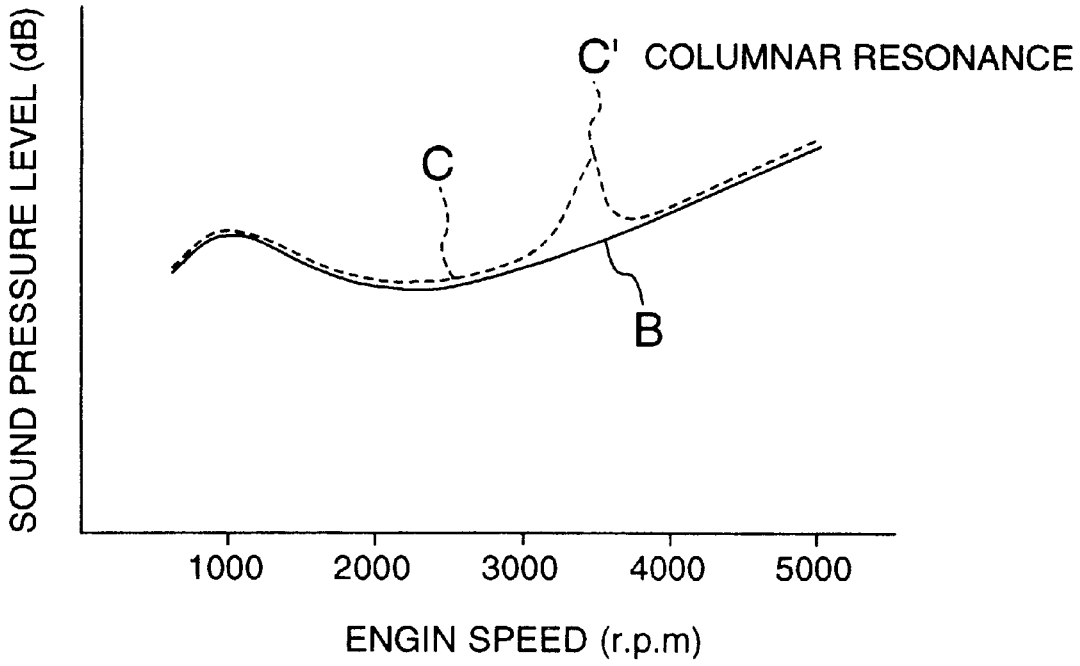
FIG. 5 is a diagram showing a sound pressure level relative to an engine revolution speed, in which a solid line B represents characteristics of the muffler of the invention, and a broken line C represents characteristics of the conventional muffler.

With respect to the above flow of the exhaust gas, since the overall length of the second exhaust outlet pipe 17 is shorter than that of the second exhaust outlet pipe 14 of the conventional muffler of FIG. 4, the columnar resonance frequency of the second exhaust outlet pipe 17 of the invention shifts to a high-frequency side as compared with the conventional construction, as shown in FIG. 5. Therefore, the characteristics, as indicated by a solid line B, are obtained, and a columnar resonance due to the pulsation of the engine is prevented from occurring. Even if a columnar resonance due to the engine pulsation occurs, any serious abnormal sound will not be produced since the engine pulsation decreases as the engine revolution speed (that is, the frequency) increases.

When the overall length $L_1$ of the second exhaust outlet pipe 17 is generally equal to the overall length $L_2$ of the first exhaust outlet pipe 12, the columnar resonance frequencies, possessed respectively by the first and second exhaust outlet pipes 12 and 17, can be set to their respective maximum values while achieving the satisfactory sound-suppressing effect (so-called long tail effect) in the low engine revolution speed range, and this is effective.

The opening-closing means 13 is provided at the exhaust inlet end of the first exhaust outlet pipe 12, and therefore by providing the joint portion A immediately adjacent to this opening-closing means 13, the overall lengths of the first and second exhaust outlet pipes 12 and 17 can be set to their respective required minimum values if the exhaust passage (path), required for obtaining the above long tail effect, is constant. Namely, the columnar resonance frequency of each of the two exhaust outlet pipes can be set to a high value.

The second exhaust outlet pipe 17 is smaller in diameter than the first exhaust outlet pipe 12, and therefore the exhaust gas flows through the second exhaust outlet pipe 17 in the low engine revolution speed range, so that the satisfactory sound-suppressing effect can be obtained.

When the amount of the exhaust gas increases in the engine revolution speed range higher than the low speed range, the flow of the exhaust gas is so changed that the exhaust gas can flow through the first exhaust outlet pipe 12 of a larger diameter, and therefore the production of a gas flow sound can be suppressed, and besides the back pressure will not increase.

The second exhaust outlet pipe 17 is shorter than that of the conventional construction, and therefore this second exhaust outlet pipe 17 need to be turned or bent only adjacent to the front wall 2 of the muffler, and the muffler of the invention can be formed into a compact design as compared with the conventional construction in which the second exhaust outlet pipe is arranged to extend along one side wall of the muffler as well as adjacent to the front wall thereof.

The opening-closing means 13 of this embodiment may be replaced by modified means in which there is provided valve member-operating means comprising an actuator such as a solenoid valve, and there is provided control means for detecting the engine revolution speed so as to control the valve member-operating means. In this case, the valve member is closed in a low engine revolution speed range, and the valve member is opened in an engine revolution speed range higher than the low revolution speed range. With this construction, also, similar operation and effects as described above can be achieved.

However, as described above in this embodiment, by providing the opening-closing means 13 in which the valve member 13*a* is opened and closed in accordance with the pressure of the exhaust gas within the chamber to which the exhaust inlet end of the first exhaust outlet pipe 12 is open, the above valve member-operating means and control means are not needed, and the muffler can be formed into a more compact design at lower costs.

The valve member 13*a* of the opening-closing means 13 is opened toward the inner side of the first exhaust outlet pipe 12, and therefore the exhaust inlet end of the first exhaust outlet pipe 12 can be located close to the front wall 2, and therefore the degree of freedom of the muffler design is enhanced.

Figure 3:
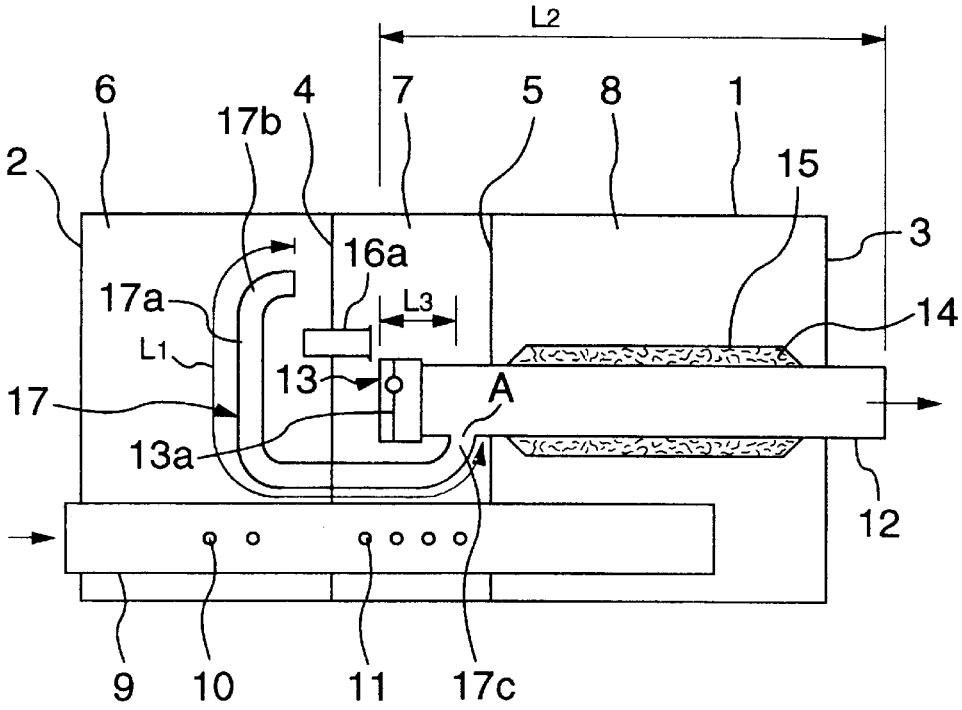
FIG. 3 is a schematic sectional elevation of a second embodiment of a muffler according to the invention.

FIG. 3 shows a second embodiment according to the invention.

In this second embodiment, an exhaust inlet end of a first exhaust outlet pipe 12 is open to a second chamber 7, and opening-closing means 13 as described above for the first embodiment is provided at this open end. A second exhaust outlet pipe 17 extends through a partition wall 4, and is received within a first chamber 6 and the second chamber 7. One end 17*b* of the second exhaust outlet pipe 17 is open to the first chamber 6 while the other end 17*c* thereof is disposed within the second chamber 7, and is connected or joined to the first exhaust outlet pipe 12 at a downstream portion of the opening-closing means 13.

A communication pipe 16*a,* corresponding to the communication pipe 16 of the first embodiment, is smaller in diameter than the first exhaust outlet pipe 12, and is generally equal in diameter to the second exhaust outlet pipe 17.

The other construction of the second embodiment is similar to that of the first embodiment, and therefore identical portions will be designated by identical reference numerals, respectively, and explanation thereof will be omitted.

In this second embodiment, in a low engine revolution speed range, exhaust gas is discharged sequentially through the exhaust inlet pipe 9, the second perforations 11, the second chamber 7, the communication pipe 16*a,* the first chamber 6, the second exhaust outlet pipe 17, a joint portion A and the first exhaust outlet pipe 12.

In an engine revolution speed range higher than the low revolution speed range, the pressure of the exhaust gas within the second chamber 7 increases, so that a valve member 13*a* of the opening-closing means 13 is opened. Therefore, in the engine revolution speed range higher than the low revolution speed range, the exhaust gas, flowed into the second chamber 7, mainly flows therefrom directly through the opening-closing means 13 of a larger diameter and the first exhaust outlet pipe 12 rather than through the above exhaust passage (path) used in the low engine revolution speed range.

Therefore, in this second embodiment, the effects of the first embodiment can be achieved, and besides the back pressure is further reduced since a large proportion of the exhaust gas will not flow through the communication pipe 16*a* in contrast with the first embodiment in which the exhaust gas flows through the communication pipe 16.

As described above, in the present invention as defined in claim 1, the production of abnormal sounds in the second exhaust outlet pipe is prevented in the low engine revolution speed range.

In the invention as defined in claim 2, the sound-suppressing effect is further enhanced.

In the invention as defined in claims 3 to 8, the muffler can be formed into a more compact design at lower costs with a higher degree of freedom of design, as compared with the conventional muffler.

In the invention as defined in claims 9 to 12, there is provided the opening-closing means which achieves the intended function with the simple construction.

What is claimed is:

1. A muffler, comprising:

a first exhaust outlet pipe;

an opening-closing means provided to said first exhaust outlet pipe; and a second exhaust outlet pipe connected to said first exhaust outlet pipe at a downstream portion of the opening-closing means, wherein an overall length of said second exhaust outlet pipe is greater than a length of a portion of said first exhaust outlet pipe extending between a joint portion, at which said second exhaust outlet pipe is connected to said first exhaust outlet pipe, and an exhaust inlet end of said first exhaust outlet pipe, and the overall length of said second exhaust outlet pipe is shorter than or generally equal to an overall length of the said first exhaust outlet pipe.

2. A muffler according to claim 1, wherein said muffler is divided into a plurality of chambers, one of said chambers, to which the exhaust inlet of said first exhaust outlet pipe is open, being communicated to other of the chambers provided on an upstream side of the former chamber by a communication pipe, and wherein said second exhaust outlet pipe is smaller in diameter than said first exhaust outlet pipe and the communication pipe.

3. A muffler according to claim 1, wherein part of said second exhaust outlet pipe is projected only outwardly of a front wall of said muffler.

4. A muffler according to claim 1, wherein the whole of said second exhaust outlet pipe is received within said muffler.

5. A muffler according to claim 2, wherein part of said second exhaust outlet pipe is projected only outwardly of a front wall of said muffler.

6. A muffler according to claim 2, wherein the whole of said second exhaust outlet pipe is received within said muffler.

7. A muffler according to claim 1, in which said opening-closing means has a valve member, and said opening-closing means is provided at the exhaust inlet end of said first exhaust outlet pipe, and said valve member is opened toward an inner side of said first exhaust outlet pipe by a pressure of exhaust gas within a chamber to which said first exhaust outlet pipe is open.

8. A muffler according to claim 2, in which said opening-closing means has a valve member, and said opening-closing means is provided at the exhaust inlet end of said first exhaust outlet pipe, and said valve member is opened toward an inner side of said first exhaust outlet pipe by a pressure of exhaust gas within a chamber to which said first exhaust outlet pipe is open.

9. A muffler according to claim 3, wherein said opening-closing means has a valve member, and said opening-closing means is provided at the exhaust inlet end of said first exhaust outlet pipe, and said valve member is opened toward an inner side of said first exhaust outlet pipe by a pressure of exhaust gas within a chamber to which said first exhaust outlet pipe is open.

10. A muffler according to claim 4, wherein said opening-closing means has a valve member, and said opening-closing means is provided at the exhaust inlet end of said first exhaust outlet pipe, and said valve member is opened toward an inner side of said first exhaust outlet pipe by a pressure of exhaust gas within a chamber to which said first exhaust outlet pipe is open.

11. A muffler according to claim 5, wherein said opening-closing means has a valve member, and said opening-closing means is provided at the exhaust inlet end of said first exhaust outlet pipe, and said valve member is opened toward an inner side of said first exhaust outlet pipe by a pressure of exhaust gas within a chamber to which said first exhaust outlet pipe is open.

12. A muffler according to claim 6, wherein said opening-closing means has a valve member, and said opening-closing means is provided at the exhaust inlet end of said first exhaust outlet pipe, and said valve member is opened toward an inner side of said first exhaust outlet pipe by a pressure of exhaust gas within a chamber to which said first exhaust outlet pipe is open.

13. A muffler according to claim 7, wherein said opening-closing means comprises said valve member of the butterfly type, and a coil spring urging said valve member in its closing direction.

14. A muffler according to claim 8, wherein said opening-closing means comprises said valve member of the butterfly type, and a coil spring urging said valve member in its closing direction.

15. A muffler according to claim 9, wherein said opening-closing means comprises said valve member of the butterfly type, and a coil spring urging said valve member in its closing direction.

16. A muffler according to claim 10, wherein said opening-closing means comprises said valve member of the butterfly type, and a coil spring urging said valve member in its closing direction.

17. A muffler according to claim 11, wherein said opening-closing means comprises said valve member of the butterfly type, and a coil spring urging said valve member in its closing direction.

18. A muffler according to claim 12, wherein said opening-closing means comprises said valve member of the butterfly type, and a coil spring urging said valve member in its closing direction.

* * * * *